US006325960B1

(12) United States Patent
Kayser et al.

(10) Patent No.: US 6,325,960 B1
(45) Date of Patent: Dec. 4, 2001

(54) CALENDER FOR FIBROUS MATERIAL WEBS AND METHOD OF OPERATING SAME

(75) Inventors: Franz Kayser, Geldern; Joachim Hinz, Kempen; Mathias Helmus, Tönisvorst; Gerhard Stock, Krefeld, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/353,343

(22) Filed: Jul. 15, 1999

(30) Foreign Application Priority Data

Jul. 16, 1998 (DE) ..... 198 32 064

(51) Int. Cl.[7] ..... B29C 43/24; B29C 43/46; B30B 3/04; D21G 1/00

(52) U.S. Cl. ..... 264/280; 100/162 R; 100/168; 100/331; 100/334; 425/367; 425/368

(58) Field of Search ..... 264/175, 280; 425/367, 368; 100/162 R, 168, 331, 334

(56) References Cited

U.S. PATENT DOCUMENTS

| | | | |
|---|---|---|---|
| 3,154,008 | 10/1964 | Hurter . | |
| 4,366,752 | 1/1983 | Koski . | |
| 5,755,156 * | 5/1998 | Stein et al. | 100/331 |

FOREIGN PATENT DOCUMENTS

| | | |
|---|---|---|
| 674203 | 4/1996 | (BE) . |
| 3119677 | 1/1982 | (DE) . |
| 3004913 | 7/1982 | (DE) . |
| 19633671 | 3/1998 | (DE) . |
| 661405 | 7/1995 | (EP) . |
| 735185 | 10/1996 | (EP) . |
| 822289 | 2/1998 | (EP) . |
| 921296 | 3/1963 | (GB) . |
| 2049516 | 12/1980 | (GB) . |
| 2158116 | 11/1985 | (GB) . |
| 2220011 | 12/1989 | (GB) . |

* cited by examiner

*Primary Examiner*—Leo B. Tentoni
(74) *Attorney, Agent, or Firm*—Greenblum & Bernstein P.L.C.

(57) ABSTRACT

Calender for a fibrous material web and method of operating a calender for a fibrous material web. The calender includes a first roll stack and a second roll stack each arranged in a common plane on a stanchion, each roll stack having a top deflection adjustment roll having a sleeve, a bottom deflection adjustment roll having a sleeve, and three intermediate rolls disposed between the top deflection adjustment roll and the bottom deflection adjustment roll, the uppermost the intermediate roll being fixedly mounted to the stanchion. The calender further has a deflection adjustment device having a sleeve lift supporting each sleeve, at least one deflection adjustment device facing the first roll stack in a first operative position and facing the second roll stack in a second operative position. A nonrotatable bracket supporting each deflection adjustment device and fixedly mounted to the stanchion is also provided. The bottom roll of the first roll stack and the top roll of the second roll stack are disposed adjacent to each other and adapted to form a nip therebetween by closing a sleeve lift of at least one of the bottom roll of the first roll stack and the top roll of the second roll stack. Also provided is a method of operating a calender for a fibrous material web.

29 Claims, 2 Drawing Sheets

CALENDER FOR FIBROUS MATERIAL WEBS AND METHOD OF OPERATING SAME

CROSS REFERENCE TO RELATED APPLICATIONS

The present application claims priority under 35 U.S.C. §119 of German Patent Application No. 198 32 064.7, filed on Jul. 16, 1998, the disclosure of which is expressly incorporated by reference herein in its entirety.

BACKGROUND OF THE INVENTION

1. Field of the Invention

The invention relates to a calender for fibrous material webs and a method of operating a calender for fibrous material webs having two roll stacks arranged in a common plane on a stanchion, each of which has a top roll, a bottom roll, and three intermediate rolls, in which the top roll and the bottom roll are each embodied as a deflection adjustment roll with a sleeve which is supported by way of a deflection adjustment device on a rotationally fixed bracket.

2. Discussion of Background Information

In a known calender discussed in German Patent Document No. DE 196 33 671 A1, two roll stacks of five rolls each are provided, and are arranged one above the other in a common vertical plane. The stacks are passed through by the paper web. The top roll is stationarily attached to a stanchion and the bottom roll is attached to a carriage that can be moved and loaded in the direction of the roll stack by a hydraulic cylinder. The sleeves of the deflection adjustment rolls are supported on their ends on respective brackets while the brackets are stationarily held on the stanchion or carriage. Each change in the load leads to a change in the roll stack.

The use of sleeve lift-type deflection adjustment rolls and bottom rolls of a roll stack is known from German Patent Document No. DE 30 04 913 C2. In such a device, however, the sleeve of the one end roll is moved during operation until it rests against a stop so that the position of the sleeve is fixed in relation to the stanchion.

SUMMARY OF THE INVENTION

The present invention provides a calender for a fibrous material web such as paper or the like, and further provides a method of operating a calender for a fibrous material web.

The calender includes a first roll stack and a second roll stack each arranged in a common plane on a stanchion, each roll stack having a top deflection adjustment roll having a sleeve, a bottom deflection adjustment roll having a sleeve, and three intermediate rolls disposed between the top deflection adjustment roll and the bottom deflection adjustment roll, the uppermost the intermediate roll being fixedly mounted to the stanchion. The calender further has a deflection adjustment device having a sleeve lift supporting each sleeve. At least one deflection adjustment device faces the first roll stack in a first operative position and faces the second roll stack in a second operative position. The calender also includes a nonrotatable bracket supporting each deflection adjustment device and fixedly mounted to the stanchion. The bottom roll of the first roll stack and the top roll of the second roll stack are disposed adjacent to each other and adapted to form a nip therebetween by closing a sleeve lift of at least one of the bottom roll of the first roll stack and the top roll of the second roll stack.

The calender may further include a lift guide and an adjusting device, at least one deflection adjustment device having a plurality of support elements. Also the lift guide and the adjusting device are adapted to revolve, by approximately 180°, at least one of the plurality of support elements about a central axis of a deflection adjustment roll.

Also, the calender may have a plurality of levers and a plurality of pivoting axles, each lever adapted to support a respective one of the second and third intermediate rolls of the first and second roll stack. The levers may be adapted to pivot about a respective pivoting axle of the plurality of pivoting axles. The pivoting axles are also fixedly mounted to the stanchion.

The top deflection adjustment roll, the bottom deflection adjustment roll, and the second intermediate roll of each roll stack may have an elastic cover, and the first and third intermediate rolls of each roll stack each may be heatable, hard rolls.

The calender may further have a feeder device adapted to insert the web through all nips of each of the roll stacks and through the auxiliary nip. Also, each roll may further include a drive. The calendar may also operate on the fly.

Additionally, the common plane may extend obliquely to the horizontal, preferably extending about 45°. The stanchion may extend generally parallel to the common plane and may be supported from below and above by bearing faces, the bearing faces being fixedly mounted to a structure. Also, the bearing faces may be concrete pedestals.

The rolls may be arranged on the oblique top side of the stanchion. The calender may further have a hydraulic adjustment device adapted to move at least one roll generally perpendicular to the common plane.

The calender may yet still have a roll bracket adapted to hold one of the bottom roll of the first roll stack and the top roll of the second roll stack, a cam disk adapted to hold the roll bracket, and a bearing adapted to support the cam disk. The cam disk may be further adapted to reduce the distance between the bottom roll of the first roll stack and the top roll of the second roll stack. An adjustment device adapted to rotate the cam disk by approximately 180° may further be provided.

The calender may also have a drier having a last drying roll and a drying device. The last drying roll and the winding device may be arranged at approximately the same height.

The method of operating the above calender may include forming a nip between the bottom roll of the first roll stack and the top roll of the second roll stack, and closing a sleeve lift of at least one of the bottom roll of the first roll stack and the top roll of the second roll stack.

The method may also include revolving, by a lift guide and an adjusting device, by approximately 180°, at least one support element about a central axis of a sleeve.

Further, the method may include supporting a respective one of the second and third intermediate rolls of the first and second roll stack, and pivoting the levers about a respective pivoting axle of the plurality of pivoting axles.

Also, the method may include inserting the web, via a feeder device, through all nips of each of the two roll stacks and also inserting the web through the auxiliary nip. The calendar may also be operated on the fly.

The stanchion may be supported from below and above on bearing faces, and the bearing faces may be fixedly mounted to a structure. Also, a hydraulic adjustment device may be used to move at least one roll generally perpendicular to the common plane.

Also, the distance between the bottom roll of the first roll stack and the top roll of the second roll stack may be reduced by using a cam disk. An adjustment device may be used to rotate the cam disk by approximately 180°.

The present invention further provides a calender that is suitable for the production of a large variety of different paper qualities.

In the present invention, all of the deflection adjustment rolls are of the sleeve lift-type having brackets that are fixedly mounted on the stanchion. The topmost intermediate rolls are fixedly mounted on the stanchion, and the bottom roll of the first roll stack and the top roll of the second roll stack are arranged adjacent to each other and can form an auxiliary nip that can be closed by using the sleeve lift. Also, the deflection adjustment device is adapted to face the first roll stack in a first operative position and face the second roll stack in a second operative position.

There are two regions in each roll stack, namely the uppermost nip and the remaining nips (i.e., a total of four regions) in which compressive stresses that are independent of each other are spread virtually over the entire line load range. The maximum compressive stress may be applied to the uppermost nip, which improves the satination effect on the web. Moreover, the paper web may be treated in an auxiliary nip, for example, to produce a matte satination, if the deflection adjustment rolls being used have an elastic surface. The auxiliary nip can also be used if a repair or a change has to be performed in the remaining rolls of the roll stack. The top and bottom rolls exert a load on the roll stack from both ends in approximately the same manner. A single reserve roll may replace any of the four end rolls.

The deflection adjustment device may include a series of support elements which, with a lift guide, can be moved by an angle of 180° by use of an adjusting device. The desired direction is achieved by actuating the adjusting device. The entire bracket to which the support elements and the lift guide are attached may be rotated by 180°.

The second and third intermediate rolls of each roll stack may be supported on levers that pivot about pivot axles stationarily attached to the stanchion. These intermediate rolls can therefore follow a low-friction change in the load via the bottom rolls. The nips arranged beneath the topmost nip open automatically when the bottom roll is lowered.

In each roll stack, the top roll, the center (i.e., second) intermediate roll, and the bottom roll each may have an elastic surface, and the remaining (i.e., first and third) intermediate rolls may be heatable hard rolls. This arrangement makes it possible in each of the two roll stacks to guide the one or the other of the two web surfaces against one heated hard roll in all of the nips and to thus obtain a paper that is uniformly satinated on both sides.

A feeder device may be provided for inserting the web through all of the nips of the two roll stacks and through the auxiliary nip. Therefore, using only a single feeder device, all of the nips may be supplied, and only the nips that are closed due to the loading of the deflection adjustment devices are operative. The web travels unhindered through the opened nips. Also, each roll of the two roll stacks has a separate drive, which facilitates the passage of the web through open nips.

The calender may be suited for online or "on the fly" operation. The separate drives of each roll permit accurate insertion of the paper web, which approaches at a high speed. Also as a result of this "on the fly" operation, if interruptions are necessary due to repair or replacement of a roll, then the paper web may still be treated in the auxiliary nip, which produces usable paper of a different quality, but the paper quantity returned to the pulper is kept to a minimum.

The common plane may obliquely extend to the horizontal and the stanchion (which extends approximately parallel to the common plane) may be supported from below and from above. The oblique position is a result of the stanchion being supported at two points. The double support results in a largely vibration-free stanchion. The height of the calender of the present invention is lower than with a vertical stanchion having ten rolls arranged one above the other. The length is shorter than with two vertical five-roll calenders arranged one after the other. Changing of rolls is simplified since a crane can be more easily used in an obliquely extending clock than in a vertical roll stack. Therefore, roll changing is possible during operation "on the fly," in which only the section where the roll to be replaced is arranged need be rendered inoperative due to the opening of the nips.

It is further advantageous for the stanchion to be supported from below and from above by bearing faces that are affixed to a structure such as a building. As a result, forces may be favorably deflected.

It is advantageous if the bearing faces are concrete pedestals. This kind of concrete support is more reasonably priced and easier to manufacture than other supports.

Most favorable values (e.g., low height and short length) exist when the common plane extends at an angle of approximately 45° from the horizontal.

The rolls are preferably arranged along the oblique top (i.e., upper) side of the stanchion, at least one roll should be movable at right angles to the plane by a hydraulic adjustment device. It is sufficient to move this roll out a relatively short distance so that it can be grasped directly by a crane and vertically transported.

Bearings for the bracket should have at least one deflection adjustment roll cam disk, which reduces the distance between the neighboring deflection adjustment rolls. The deflection adjustment roll can also be used when the sleeve lift alone is insufficient to close the auxiliary nip.

The cam disks, with the bracket, are ideally rotatable by 180° by use of the adjusting device. One adjusting device is thus sufficient for adjusting the bracket and the cam disk.

The last drying roll of a drier section and a winding device are arranged at approximately the same height. Due to the oblique inclination of the calender, the web section between the drying roll and the calender and the web section between the calender and the winding device may easily extend upwardly, which is favorable for the insertion of the paper web in an online or "on the fly" operation.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
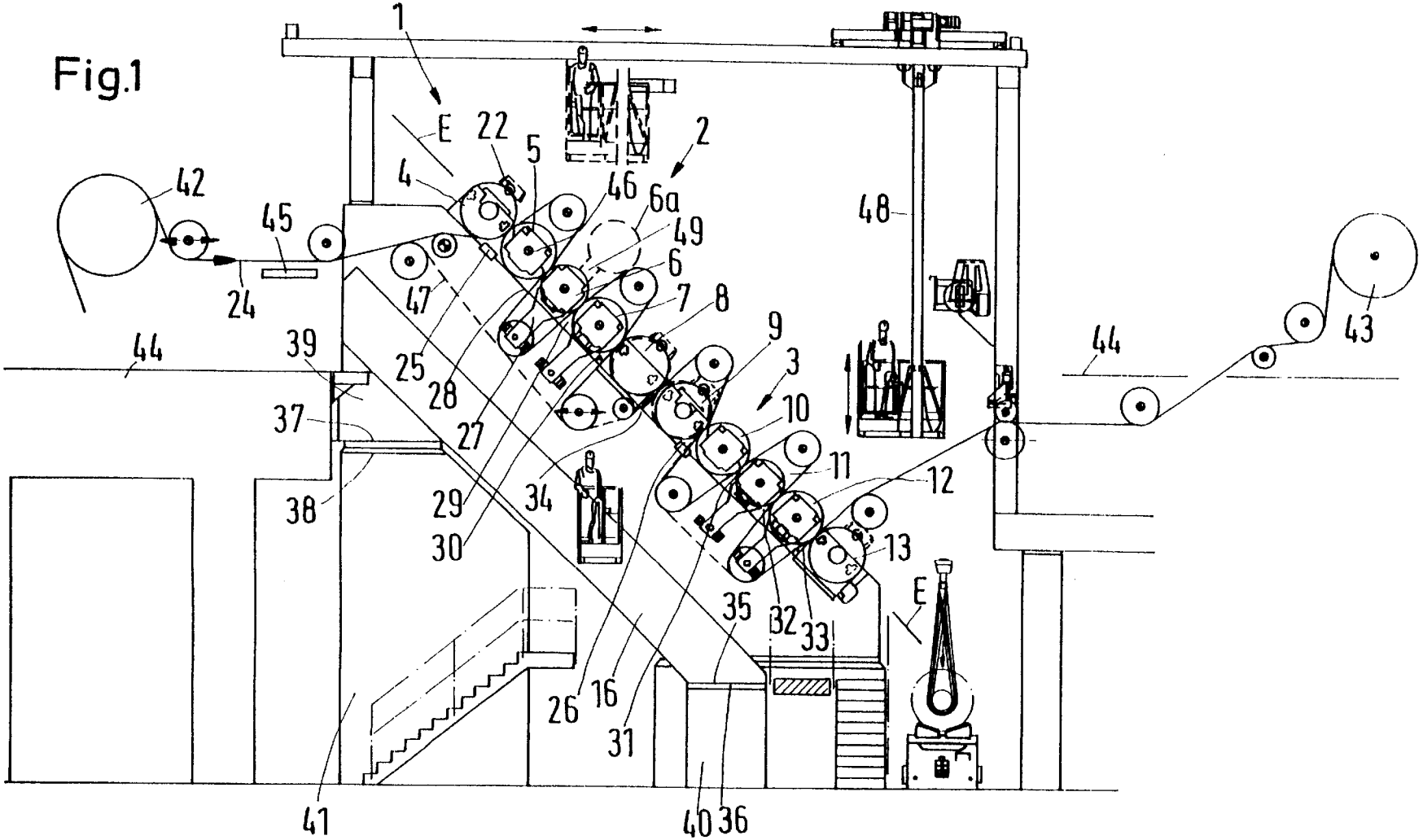
FIG. 1 is a schematic side view of a calender according to the invention.

Referring now to FIG. 1, a calender 1 has an upper, first five-roll stack 2 and a lower, second five-roll stack 3. The upper roll stack 2 includes a top roll 4, three intermediary rolls 5, 6, and 7, and a bottom roll 8. The lower roll stack 3 includes a top roll 9, three intermediary rolls 10, 11, and 12, and a bottom roll 13.

Figure 2:
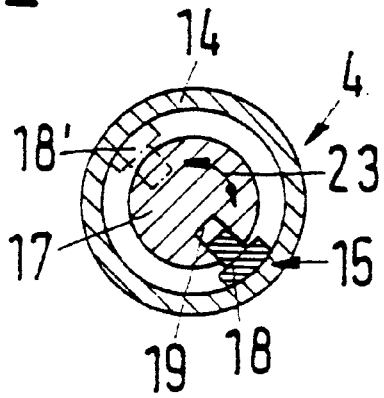
FIG. 2 is a cross-section through the central region of a deflection adjustment roll.
Figure 3:
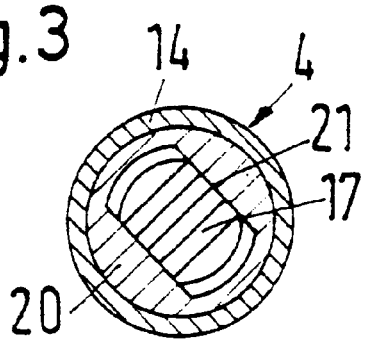
FIG. 3 is a cross-section through the end region of a deflection adjustment roll.

The top and bottom rolls (i.e., the end rolls) 4, 8, 9, and 13 are deflection adjustment rolls of the sleeve lift type. These rolls can have the same structure as one another so that one reserve roll (not shown) may replace any of the four end rolls 4, 8, 9, and 13. Referring to FIGS. 2 and 3, each deflection adjustment roll has a sleeve 14, which is supported by a deflection adjustment device 15 on a mounting bracket 17 that is fixedly secured to the stanchion 16 during operation. The deflection adjustment device 15 includes a series of hydrostatic support elements 18, which are supplied in a known manner with pressure fluid via a respective pressure chamber 19 such that the deflection adjustment device 15 may also be used as a loading device. At the ends, the roll sleeve 14 is supported on a bearing ring 20, which can be moved over the entire length of the roll sleeve in a lift direction on a lift guide 21, as shown in FIG. 3. In addition, the mounting bracket 17 can be rotated by an angle of approximately 180° in the direction indicated by arrow 23 by an adjusting device 22 so that the effective direction of the deflection adjustment device 15 points in the opposite direction, as shown by the series of support elements 18', shown, in phantom lines.

The uppermost intermediary rolls 5 and 10 are mounted fixedly on the stanchion 16. With the accompanying top rolls 4 and 9, if the deflection adjustment device 15 is in the position shown in FIG. 2, the paper web 24 is subject to a very high line load, with a corresponding high compressive stress in the nips 25 and 26 of the upper roll stack 2 or the lower roll stack 3 that are first in the running direction of the web.

The intermediary rolls 6, 7, 11, and 12 are each supported on a lever 27, which pivots around a pivot axle affixed to the stanchion. If the deflection adjustment devices 15 of the bottom rolls 8 and 13 are in the position shown with dashed lines in FIG. 2, the nips 28, 29, and 30 of the upper roll stack 2 and the nips 31, 32, and 33 of the lower roll stack 3 are correspondingly loaded. The level of loading is independent of nips 25 or 26. Four sections are therefore produced in which the paper web 24 can be treated differently, so that a large variety of different paper qualities can be produced.

During normal operation, an open auxiliary nip 34 exists between the two roll stacks 2 and 3, through which the paper web 24 travels unhindered. Preferably, one side of the web is satinated in the upper roll stack 2, and the other side of the web is satinated in the lower roll stack 3.

The top and bottom rolls (i.e., end rolls) 4, 8, 9, and 13, as well as the intermediate (i.e., second) rolls 7 and 11 are elastic rolls, while the remaining intermediate (i.e., first and third) rolls 5, 7, 10, and 12 are heated, hard rolls. However, other roll combinations may be used in alternative embodiments.

The distance between the two deflection adjustment rolls 9 and 10 is slight so that the auxiliary nip 34 can be closed, for example by 30–40 mm, with the roll lift. It is thus only necessary to rotate the deflection adjustment devices 15 of the two end rolls 8 and 9 toward each other with the aid of the adjusting device 22, and to then supply the pressure fluid under appropriate pressure. A matte satination can then be carried out using this auxiliary nip 34, since the two deflection adjustment rolls 8 and 9 have an elastic surface. Therefore, this provides an additional way to treat the paper web without significant additional cost.

Figure 4:
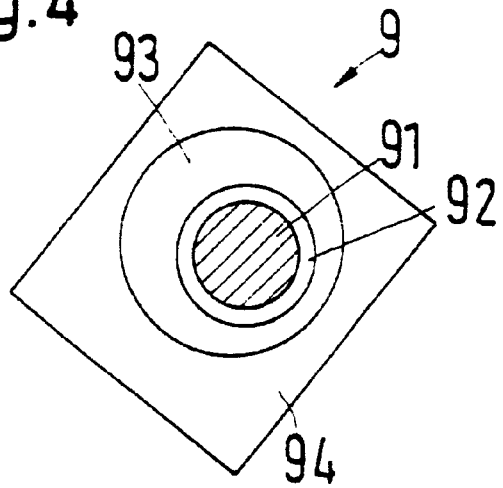
FIG. 4 is a schematic representation of the bearing of the bracket of a deflection adjustment roll.

Referring to FIG. 4, if the gap of the open auxiliary nip 34 is so large that the sleeve lift alone cannot close it, then a roll bracket 91 of the top roll 9 can be supported in a dome 92, which is in turn carried by a cam disk 93. Cam disk 93 can be rotated, together with the roll bracket 91, by 180° in a bearing 94 by the adjusting device 22. In this manner, the gap of the open auxiliary nip 34 can be reduced, for example, by approximately 80 mm, which also opens nips 28 and 29.

The axes of the rolls 4 to 13 are arranged generally in a common plane E, which is preferably inclined by approximately 45° to the horizontal. The stanchion 16 also extends obliquely. It can therefore be supported at two points, namely with a lower support face 35 on a lower bearing face 36 that is affixed to a structure such as a building, and with an upper support face 37 on an upper bearing face 38 that is fixed to the building. The bearing face 37 is arranged on a foot 39 that is attached to the stanchion 16 close to its upper end. The bearing faces 36 and 38 extend horizontally and are each embedded on a concrete pedestal or footing 40 or 41. The stanchion 16 is thus largely insensitive to vibrations.

In FIG. 1, the calender 1 is arranged between a last drying roll 42 of a drying section of a paper machine and a winding device 43, for example, a roll cutting and winding device. The drying roll and the winding device are arranged approximately at the same height above a working plane 44 of calender 1. The paper web 24 extends at a relatively slight incline between the drying roll 42 and the entry into the calender 1, as well as between the exit from the calender 1 and the winding device 43. This arrangement facilitates the insertion of the paper web during online operation. The same advantage is also realized when the paper web is introduced from the drying roll 42 into the calender 1 from below and exits at the top toward the winding device 43.

A web feeder device 45, which functions, for example, with cable clamping, conveys web 24 through all of the nips 25–33 of the two roll stacks 2 and 3, as well as the auxiliary nip 34. One insertion procedure is therefore sufficient for both roll stacks. The insertion movement is facilitated because each of the rolls of the calender 1 and each of the associated guide rolls has a respective drive 46. Paper treatment varies depending on which of the nips are closed.

A second web inserting device 47 is shown with dashed lines, which supplies only the auxiliary nip 34. With the matte satination of a web inserted in this manner, the remaining rolls can be repaired or replaced. A semi-matte operation is produced, for example, when only the uppermost nip 25 is used.

The precise inclination of the stanchion 16 is a function of on-site conditions. Plus or minus 10° from 45° fall within the preferred range, although other angles are possible in alternative embodiments.

The oblique inclination with the roll stacks arranged on top has the additional advantage that, for the purpose of exchanging rolls, they can be better accessed and exchanged using a crane 48 and a corresponding crane control. In particular, the bearings of the roll to be changed can be moved out along a guide generally perpendicular to the plane E, as shown with dashed lines in FIG. 1, by a hydraulic adjustment device 49. The piston of a hydraulic cylinder that extends along the lever 27 is primarily used by the hydraulic adjustment device 49. In the outside position, the crane 48 can directly grasp the roll ends and remove the roll vertically.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender for a fibrous material web, comprising:

a first roll stack and a second roll stack each arranged in a common plane on a stanchion, each said roll stack comprising:

a) a top deflection adjustment roll having a sleeve;

b) a bottom deflection adjustment roll having a sleeve; and c) three intermediate rolls disposed between said top deflection adjustment roll and said bottom deflection adjustment roll, the uppermost said intermediate roll being fixedly mounted to the stanchion;

a deflection adjustment device having a sleeve lift and supporting each said sleeve, at least one said deflection adjustment device adapted to face said first roll stack in a first operative position and face said second roll stack in a second operative position; and a nonrotatable bracket supporting each said deflection adjustment device and fixedly mounted to the stanchion;

wherein the bottom roll of said first roll stack and said top roll of said second roll stack are disposed adjacent to each other and adapted to form a nip therebetween by closing a said sleeve lift of at least one of the bottom roll of said first roll stack and said top roll of said second roll stack.

2. The calender according to claim 1, further comprising:

a lift guide; and an adjusting device;

wherein said at least one deflection adjustment device comprises a plurality of support elements, and wherein said lift guide and said adjusting device are adapted to revolve at least one of said plurality of support elements about a central axis of a said deflection adjustment roll, by approximately 180°.

3. The calender according to claim 1, further comprising:

a plurality of levers, each lever of said plurality of levers adapted to support a respective one of the second and third intermediate rolls of said first and second roll stack; and a plurality of pivoting axles, said levers adapted to pivot about a respective pivoting axle of said plurality of pivoting axles, said plurality of pivoting axles fixedly mounted to the stanchion.

4. The calender according to claim 1, wherein said top deflection adjustment roll, said bottom deflection adjustment roll, and said second intermediate roll of each said roll stack each have an elastic cover, and wherein said first and third intermediate rolls of each said roll stack each are heatable, hard rolls.

5. The calender according to claim 1, further comprising a feeder device adapted to insert the web through all nips of each of said two roll stacks, and further adapted to insert the web through an auxiliary nip.

6. The calender according to claim 1, wherein each said roll of said two roll stacks further comprises a drive.

7. The calender according to claim 1, wherein:

the common plane extends obliquely to the horizontal; and the stanchion extends generally parallel to the common plane and is supported from below and above.

8. The calender according to claim 7, wherein the stanchion is supported from below and above on bearing faces, said bearing faces being fixedly mounted to a structure.

9. The calender according to claim 8, wherein said bearing faces are concrete pedestals.

10. The calender according to claim 7, wherein the common plane is at an angle of approximately 45° to the horizontal.

11. The calender according to claim 7, wherein the stanchion has a top surface and a bottom surface, and wherein said rolls are arranged on the oblique top side of the stanchion, the calender further comprising a hydraulic adjustment device adapted to move at least one said roll generally perpendicular to the common plane.

12. The calender according to claim 1, further comprising:

a roll bracket adapted to hold one of the bottom roll of said first roll stack and said top roll of said second roll stack;

a cam disk adapted to hold said roll bracket; and a bearing adapted to support said cam disk, said cam disk further adapted to reduce the distance between the bottom roll of said first roll stack and said top roll of said second roll stack.

13. The calender according to claim 12, further comprising an adjustment device adapted to rotate said cam disk by approximately 180°.

14. The calender according to claim 12, further comprising:

a drier having a last drying roll; and a drying device;

wherein said last drying roll and said winding device are arranged at approximately the same height.

15. A method of operating a calender for a fibrous material web, the calender having a first roll stack and a second roll stack each arranged in a common plane on a stanchion, each roll stack having a top deflection adjustment roll having a sleeve, a bottom deflection adjustment roll having a sleeve, and three intermediate rolls disposed between the top deflection adjustment roll and the bottom deflection adjustment roll, the uppermost intermediate roll being fixedly mounted to the stanchion, the calender further having a deflection adjustment device having a sleeve lift and supporting each sleeve, at least one deflection adjustment device facing the first roll stack in a first operative position and facing the second roll stack in a second operative position, and a nonrotatable bracket supporting each deflection adjustment device and fixedly mounted to the stanchion, the method comprising:

forming a nip between the bottom roll of the first roll stack and the top roll of the second roll stack; and closing a sleeve lift of at least one of the bottom roll of the first roll stack and the top roll of the second roll stack.

16. The method of operating a calender according to claim 15, the calender further having a lift guide and an adjusting device, the at least one deflection adjustment device having a plurality of support elements, the method further comprising revolving, via the lift guide and the adjusting device, the at least one of the plurality of support elements about a central axis of a deflection adjustment roll, by approximately 180°.

17. The method of operating a calender according to claim 15, the calender further having a plurality of levers and a plurality of pivoting axles fixedly mounted to the stanchion, the method further comprising:

supporting a respective one of the second and third intermediate rolls of the first and second roll stack; and pivoting the levers about a respective pivoting axle of the plurality of pivoting axles.

18. The method of operating a calender according to claim 15, wherein the top deflection adjustment roll, the bottom deflection adjustment roll, and the second intermediate roll of each roll stack each has an elastic cover, and wherein the first and third intermediate rolls of each roll stack each are heatable, hard rolls.

19. The method of operating a calender according to claim 15, the calender further having a feeder device, the method further comprising:

inserting the web, via the feeder device, through all nips of each of the two roll stacks; and inserting the web, via the feeder device, through an auxiliary nip.

20. The method of operating a calender according to claim 15, wherein each roll of the two roll stacks further comprises a drive.

21. The method of operating a calender according to claim 15, further comprising operating the calendar on the fly.

22. The method of operating a calender according to claim 15, wherein:

the common plane extends obliquely to the horizontal; and the stanchion extends generally parallel to the common plane and is supported from below and above.

23. The method of operating a calender according to claim 22, further comprising supporting the stanchion from below and above on bearing faces, the bearing faces being fixedly mounted to a structure.

24. The method of operating a calender according to claim 23, wherein the bearing faces are concrete pedestals.

25. The method of operating a calender according to claim 22, wherein the common plane is at an angle of approximately 45° to the horizontal.

26. The method of operating a calender according to claim 22, wherein the stanchion has a top surface and a bottom surface, and wherein the rolls are arranged on the oblique top side of the stanchion, the method further comprising using a hydraulic adjustment device to move at least one roll generally perpendicular to the common plane.

27. The method of operating a calender according to claim 15, the calender having a roll bracket holding one of the bottom roll of the first roll stack and the top roll of the second roll stack, a cam disk holding the roll bracket, and a bearing supporting the cam disk, the method comprising reducing, by using the cam disk, the distance between the bottom roll of the first roll stack and the top roll of the second roll stack.

28. The method of operating a calender according to claim 22, the calender further having an adjustment device, the method further comprising rotating, by using the adjustment device, the cam disk by approximately 180°.

29. The method of operating a calender according to claim 22, the calender further having a drier having a last drying roll, and a drying device, the last drying roll and the winding device being arranged at approximately the same height.

* * * * *